US011386823B2

(12) United States Patent
Jin et al.

(10) Patent No.: US 11,386,823 B2
(45) Date of Patent: Jul. 12, 2022

(54) ARRAY SUBSTRATE AND METHOD OF DRIVING THE SAME, AND DISPLAY DEVICE

(71) Applicants: HEFEI BOE OPTOELECTRONICS TECHNOLOGY CO., LTD., Hefei (CN); BOE TECHNOLOGY GROUP CO., LTD., Beijing (CN)

(72) Inventors: Tingting Jin, Beijing (CN); Liangliang Zheng, Beijing (CN); Site Cai, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 354 days.

(21) Appl. No.: 16/604,789

(22) PCT Filed: Apr. 24, 2019

(86) PCT No.: PCT/CN2019/084065
§ 371 (c)(1),
(2) Date: Oct. 11, 2019

(87) PCT Pub. No.: WO2019/206181
PCT Pub. Date: Oct. 31, 2019

(65) Prior Publication Data

US 2021/0358364 A1 Nov. 18, 2021

(30) Foreign Application Priority Data

Apr. 25, 2018 (CN) ..... 201810381271.4

(51) Int. Cl.
*G09G 3/20* (2006.01)

(52) U.S. Cl.
CPC ..... *G09G 3/20* (2013.01); *G09G 3/2074* (2013.01); *G09G 2300/0408* (2013.01);
(Continued)

(58) Field of Classification Search
CPC ..... G09G 2310/0262; G09G 2310/021; G09G 2310/0205; G09G 2310/0208;
(Continued)

(56) References Cited

U.S. PATENT DOCUMENTS

2007/0074733 A1 4/2007 Rasouli et al.
2007/0164964 A1* 7/2007 Ha ..... G09G 3/3607 345/98

(Continued)

FOREIGN PATENT DOCUMENTS

CN 101625828 A 1/2010
CN 101996563 A 3/2011

(Continued)

*Primary Examiner* — Julie Anne Watko
(74) *Attorney, Agent, or Firm* — Kinney & Lange, P.A.

(57) ABSTRACT

The present disclosure provides an array substrate and a method of driving the same, and a display device. The array substrate includes a plurality of sets of transistors, each set of transistors include at least two columns of drive transistors. A target column of drive transistors of each set of transistors are connected to a data line, and the rest drive transistors are connected to the target column of drive transistors.

19 Claims, 5 Drawing Sheets

(52) U.S. Cl.
CPC ..... *G09G 2300/0426* (2013.01); *G09G 2300/0452* (2013.01); *G09G 2310/0262* (2013.01); *G09G 2310/08* (2013.01)

(58) Field of Classification Search
CPC ... G09G 2310/0281; G09G 2310/0297; G09G 2310/0283; G09G 2310/06; G09G 2300/0421; G09G 2300/0408; G09G 2300/0452; G09G 2300/0426; G09G 3/20; G09G 2310/08; G09G 3/2074; G09G 2300/0439; G09G 2300/04; G09G 2300/00; G09G 2300/0404; G09G 3/2007; G09G 3/2003; G09G 3/00; G09G 2310/00; G09G 2310/0286; G09G 2310/0289; G09G 2310/0291; G09G 2310/0294; G09G 2310/0243; G09G 2310/0232; G09G 2310/0227; G09G 2310/0224; G09G 2310/0216; G09G 2310/0202; G09G 2310/02; H01L 27/124
See application file for complete search history.

(56) References Cited

U.S. PATENT DOCUMENTS

| | | | | |
|---|---|---|---|---|
| 2009/0262054 | A1* | 10/2009 | Hsu | G09G 3/3648 345/87 |
| 2010/0156954 | A1* | 6/2010 | Kim | G09G 3/3614 345/690 |
| 2013/0113766 | A1* | 5/2013 | Kim | G02F 1/136227 345/205 |
| 2016/0327819 | A1* | 11/2016 | Chao | G09G 3/3659 |
| 2017/0249914 | A1* | 8/2017 | Kim | G09G 3/3614 |
| 2018/0190217 | A1* | 7/2018 | Jung | G09G 3/3607 |
| 2020/0348572 | A1* | 11/2020 | Lee | G02F 1/136209 |
| 2020/0393728 | A1* | 12/2020 | Zhang | G02F 1/133391 |

FOREIGN PATENT DOCUMENTS

| | | | |
|---|---|---|---|
| CN | 108538236 | A | 9/2018 |
| JP | 05188395 | A | 7/1993 |
| JP | 05265045 | A * | 10/1993 |

* cited by examiner

ARRAY SUBSTRATE AND METHOD OF DRIVING THE SAME, AND DISPLAY DEVICE

CROSS-REFERENCE TO RELATED APPLICATION(S)

This application is the national phase of PCT Application No. PCT/CN2019/084065 filed on Apr. 24, 2019, which in turn claims priority to Chinese Patent Application No. 201810381271.4, filed on Apr. 25, 2018 and titled as "Array substrate and method of driving the same, and display device", the disclosure of which is hereby incorporated by reference in its entirety.

TECHNICAL FIELD

The present disclosure relates to the field of display technology, and particularly, to an array substrate and a method of driving the same, and a display device.

BACKGROUND

In order to realize a narrow-border design of the display device, Gate Driver on Array (GOA) technology is generally adopted to integrate a gate driver circuit on an array substrate, so that no gate drive chip should be separately disposed on a side of the display device.

In related art, an array substrate is further disposed with a plurality of pixel units arranged in an array, a plurality of gate lines, and a plurality of data lines. Each pixel unit includes a drive transistor. Each gate line is respectively connected to a gate driving circuit and the drive transistors in a row of pixel units, for providing a gate driving signal to the drive transistors in the row of pixel units under driving of the gate driving circuit. each data line are connected to the drive transistors in a column of pixel units, for providing data signals to the drive transistors in the column of pixel units.

SUMMARY

In an aspect, there is provided an array substrate, and the array substrate comprises: a base substrate; and a plurality of data lines and a plurality of array-distributed drive transistors on the base substrate;

the plurality of array-distributed drive transistors comprise: a plurality of sets of transistors in a one-to-one correspondence with the plurality of data lines, each set of transistors comprising at least two columns of drive transistors;

in the plurality of data lines, each data line is connected to a first pole of each target drive transistor in a target column of drive transistors of a corresponding set of transistors, the target column of drive transistors are one column of drive transistors in one set of transistors;

in each set of transistors, the first pole of each drive transistor, except the target column of drive transistors, is connected to a second pole of a target drive transistor located in a different row, and the target drive transistors that are connected to the drive transistors located in a same row are different;

wherein the first pole and the second pole are respectively a source and a drain, or the first pole and the second pole are respectively a drain and a source.

In some embodiments, the target column of drive transistors are a first column of drive transistors in one set of transistors;

in each set of transistors, the first pole of each drive transistor, except the target column of drive transistors, is directly connected to a second pole of a drive transistor of a previous column of drive transistors located in a different row.

In some embodiments, in each set of transistors, the first pole of each drive transistor, except the target column of drive transistors, is directly connected to a second pole of a drive transistor of the previous column of drive transistors located in a next row.

In some embodiments, in each set of transistors, the first pole of each drive transistor, except the target column of drive transistors, is directly connected to a second pole of a drive transistor of the previous column of drive transistors located in a previous row.

In some embodiments, in each set of transistors, the first pole of each drive transistor, except the target column of drive transistors, is directly connected to a second pole of a drive transistor of the previous column of drive transistors located in the different row through a first connection line, the first connection line being disposed in a same layer as a pixel electrode of the array substrate. The first connection line can be made of indium tin oxide material.

In some embodiments, the array substrate further comprises: a plurality of gate lines and a gate drive circuit on the base substrate; the gate drive circuit is connected to each of the plurality of gate lines, and each gate line is connected to gates of drive transistors located in a same row.

In some embodiments, the plurality of data lines are configured for being connected to the source drive circuit located in a side of the array substrate;

the gate drive circuit is located at a side of the base substrate opposite to a source drive circuit, and the gate drive circuit is connected to the plurality of gate lines through a plurality of second connection lines in a one-to-one correspondence manner; the source drive circuit is located at a side of the base substrate and is configured for being connected to the plurality of data lines;

the second connection lines are in parallel with the data lines. The second connection lines can be disposed in a same layer with the data lines.

In some embodiments, the number of columns of drive transistors included in each set of transistors is equal to the number of sub-pixels included in each pixel of the array substrate. For example, each pixel comprises three sub-pixels, and each set of transistors comprise three columns of drive transistors.

In another aspect, there is provided a method of driving an array substrate, which is applied on the array substrate mentioned in the above aspect. The method comprises: a plurality of drive cycles;

in each drive cycle, driving, by gate drive signals output from N gate lines, drive transistors connected to the N gate lines to turn on;

charging, by a data signal output from each data line through the target column of drive transistors connected to the each data line, pixel electrodes connected to the drive transistors in a turn-on state;

wherein, N is the number of columns of drive transistors included in each set of transistors in the plurality of sets of transistors included in the array substrate.

In some embodiments, in each set of transistors, the first pole of each drive transistor, except the target column of drive transistors, is directly connected to a second pole of a drive transistor of a previous column of drive transistors located in a different row;

wherein the N gate lines are N adjacent gate lines, and in two adjacent drive cycles, a first gate line of the N gate lines outputting the gate drive signal in a first drive cycle is spaced apart by one row from a first gate line of the N gate lines outputting the gate drive signal in a second drive cycle.

In some embodiments, in each set of transistors, the first pole of each drive transistor, except the target column of drive transistors, is directly connected to a second pole of a drive transistor of the previous column of drive transistors located in a next row; each drive cycle comprises: N drive phases;

wherein in an nth drive phase, first N−n+1 gate lines of the N adjacent gate lines output the gate drive signals;

wherein, n is a positive integer not greater than N.

In some embodiments, in each set of transistors, the first pole of each drive transistor, except the target column of drive transistors, is directly connected to a second pole of a drive transistor of the previous column of drive transistors located in a previous row. Each drive cycle comprises: N drive phases;

wherein in an nth drive phase, last N−n+1 gate lines of the N adjacent gate lines output the gate drive signals;

wherein, n is a positive integer not greater than N.

In some embodiments, each pixel in the array substrate comprises three sub-pixels, and N is equal to 3.

In yet another aspect, there is provided a display device comprising: the array substrate mentioned in the above aspect.

In some embodiments, the display device further comprises: a source drive circuit; wherein the source drive circuit is connected to the plurality of data lines in the array substrate, and the source drive circuit is disposed opposite to the gate drive circuit in the array substrate.

In some embodiments, the display device further comprises: a timing controller; wherein the timing controller is connected to the source drive circuit and the gate drive circuit.

BRIEF DESCRIPTION OF THE DRAWINGS

In order to more clearly illustrate the technical solutions in the embodiments of the present disclosure, the drawings used in the description of the embodiments will be briefly described below. It is obvious that the drawings in the following description are only some embodiments of the present disclosure. Those skilled in the art may also obtain other drawings in view of these drawings without involving any inventive labors.

DETAILED DESCRIPTION OF THE EMBODIMENTS

Figure 1:
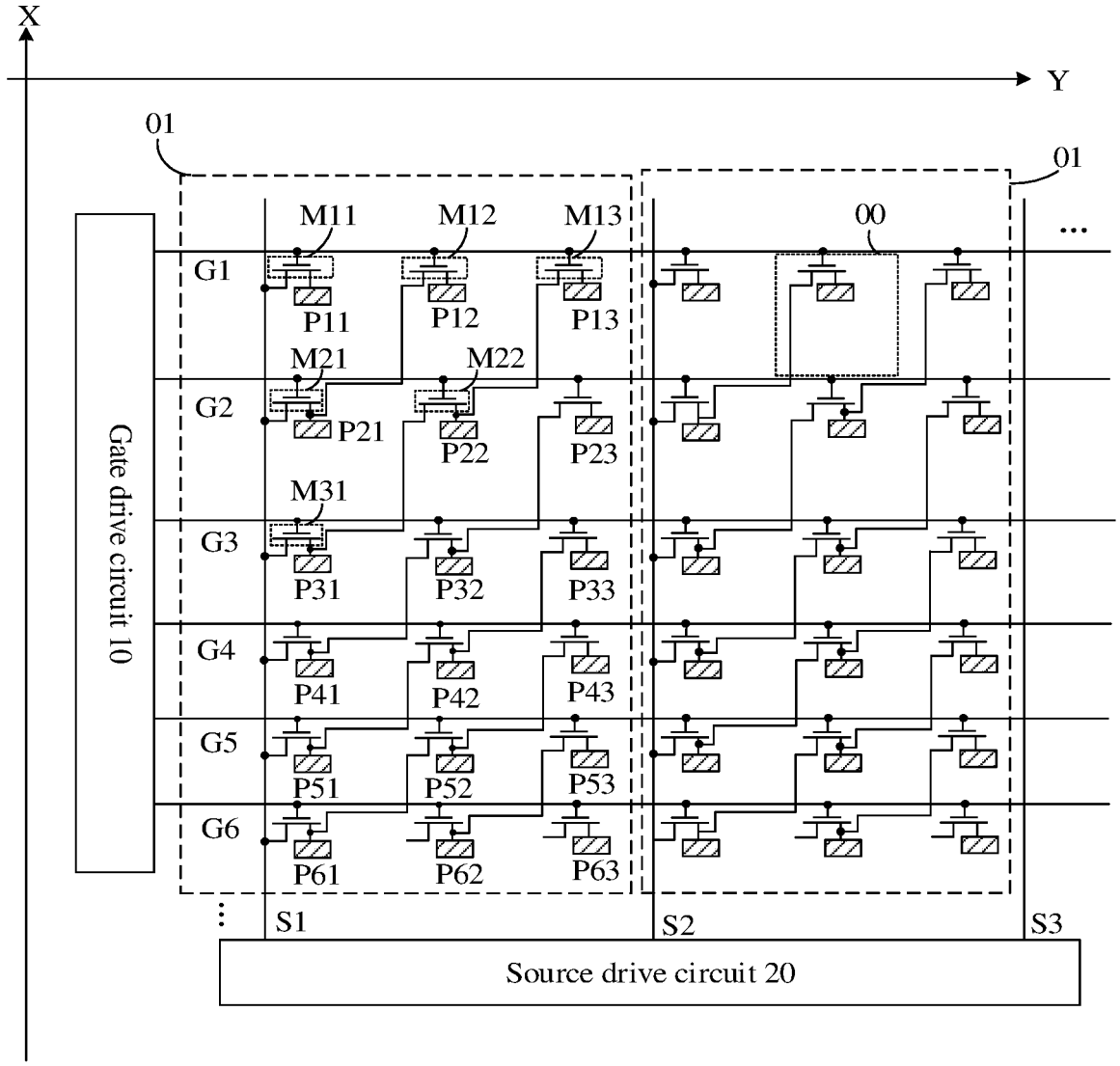
FIG. 1 is a schematic view showing a structure of an array substrate according to an embodiment of the present disclosure.

In order to make the objects, technical solutions and advantages of the present disclosure more clear, the present disclosure will be further described in detail below with reference to the accompanying drawings.

The transistors employed in all embodiments of the present disclosure may each be a thin film transistor or a field effect transistor or other device having the same characteristics, and the transistors employed in the embodiments of the present disclosure are mainly switching transistors according to the functions in the circuit. Since the source and the drain of the switching transistor employed here are symmetrical, the source and the drain are interchangeable. In the embodiments of the present disclosure, the source is referred to as a first pole and the drain is referred to as a second pole, or the drain is referred to as a first pole and the source is referred to as a second pole. According to the form in the drawings, the middle pole of the transistor is the gate, the signal input pole is the source, and the signal output pole is the drain. In addition, the switching transistor employed in the embodiments of the present disclosure may be any one of a P-type switching transistor and an N-type switching transistor, wherein, the P-type switching transistor is turned on when the gate is at a low potential, and is turned off when the gate is at a high potential; the N-type switching transistor is turned on when the gate is at a high potential, and is turned off when the gate is at a low potential.

FIG. 1 is a schematic view showing a structure of an array substrate according to an embodiment of the present disclosure. As shown in FIG. 1, the array substrate includes: a base substrate, and a plurality of data lines and a plurality of array-distributed drive transistors on the base substrate. For example, data lines S1, S2, and S3 are shown in FIG. 1.

A plurality of pixel regions 00 arranged in an array may be formed on the base substrate. Each of the pixel regions 00 may be disposed with one sub-pixel (which may also be referred to as a pixel unit), and a plurality of (for example, three) adjacent sub-pixels may constitute one pixel. Each of the sub-pixels may include one drive transistor and a pixel electrode connected to the drive transistor. The sub-pixel in the first row of the first column shown in FIG. 1 includes a drive transistor M11 and a pixel electrode P11 connected to the drive transistor M11.

As shown in FIG. 1, the array substrate may also include a plurality of gate lines, such as the gate line G1 to the gate line G6 as shown in FIG. 1. Each gate line of the plurality of gate lines may be connected to gates of the drive transistors located in the same row, and each gate line may provide a gate drive signal for the row of drive transistors connected thereto to drive the row of drive transistors to be turned on.

In the embodiments of the present disclosure, the plurality of array-distributed drive transistors may include a plurality of sets of transistors being in a one-to-one correspondence with the plurality of data lines, that is, the plurality of array-distributed drive transistors may be divided into a plurality of sets of transistors, each set of transistors 01 can include at least two columns of drive transistors. Each data line of the plurality of data lines may be connected to a first pole of each target drive transistor in a target column of drive transistors of a corresponding set of transistors 01, the target column of drive transistors may be a column of drive transistors in a set of transistors 01.

It should be noted that, the term "connect", "connected" or "connection" described in the present disclosure indicates an electrical connection but may be or may be not a physical connection. For example, "the data line is connected to a first pole of the target drive transistor" indicates that the data line is connected electrically to the first pole of the target drive transistor.

For example, in the array substrate shown in FIG. 1, each set of transistors 01 may include three columns of drive transistors, wherein the first column of drive transistors is the target column of drive transistors. Then, each data line can be connected to the first pole of each target drive transistor in the first column of drive transistors in the corresponding set of transistors 01. Each data line can provide a data signal for each target drive transistor in the target column of drive transistors to which it is connected.

For example, when the target drive transistor M11 in the first row of the first column shown in FIG. 1 is turned on under the driving of the gate line G1, the data line S1 can input a data signal to the pixel electrode P11 connected to the target drive transistor M11, thereby charging the pixel electrode.

In order to enable the other columns of drive transistors, except the target column of drive transistors, in each set of transistors 01 to receive the data signal, in the embodiments of the present disclosure, referring to FIG. 1, in each set of transistors 01, the first pole of each drive transistor, except the target column of drive transistors, can be connected to the second pole of the target drive transistor located in a different row, and the target drive transistors that are connected to the drive transistors located in the same row are different, that is, the target drive transistors that are connected to the drive transistors located in the same row are connected to different gate lines.

The first pole of the drive transistor is connected to the second pole of the target drive transistor, it may be a direct connection, for example, the two are directly connected through a first connection line; or it may be an indirect connection, for example, the two are connected through other drive transistors. The manner of connections between the drive transistor and the target drive transistor is not limited in embodiments of the present disclosure, as long as it is ensured that data signals can be transmitted between the two.

The solution provided by the embodiments of the present disclosure is that, the drive transistors other than the target drive transistors can be connected to the target drive transistor located in a different row, and the target drive transistors connected to the drive transistors located in the same row are different (i.e., the gate lines connected to the target drive transistors are different), so the timing of the gate drive signals provided by the respective gate lines can be controlled, so that the data lines can output different data signals to the respective drive transistors through the target drive transistors, thereby the pixel electrodes connected to the respective drive transistors are charged with desired potentials to achieve normal displaying of the image.

In a word, in the array substrate according to the embodiments of the present disclosure, in at least two columns of drive transistors included in each set of transistors, only the target column of drive transistors need to be connected with the data line, and the other columns of drive transistors can achieve the reception of data signals through the connection with the target column of drive transistors. Accordingly, one data line can provide data signals for multiple columns of drive transistors in a set of transistors, which effectively reduces the number of data lines required to be disposed in the array substrate, and the wiring space required by the data lines in the array substrate is reduced, thereby enabling the realization of the narrow-border display panel.

In some embodiments, as can be seen from FIG. 1, the target column of drive transistors connected to each data line may be the first column of one set of transistors. In each set of transistors, the first pole of each drive transistor, except the target column of drive transistors, can be directly connected to a second pole of a drive transistor located in a different row of a previous column of drive transistors.

That is, in each set of transistors, the first pole of each drive transistor in the second column of drive transistors can be directly connected to the second pole of the target drive transistor located in a different row of the target column of drive transistors. The first pole of each drive transistor, except the first and second columns of drive transistors, can be indirectly connected to the second pole of the target drive transistor located in a different row through the intermediate column of drive transistors.

For example, as can be seen from FIG. 1, the second pole of each drive transistor in each column of drive transistors can be connected to the first pole of the drive transistor in the previous or next row of the next column of drive transistors. After the first column of drive transistors receive the data signal input by the data line, the data signal can be written to the drive transistor in the previous row, or in the next row, of the next column of drive transistors.

A first column of drive transistors in each set of transistors are used as the target column of drive transistors, and each of the other drive transistors is connected to the previous column of drive transistors, which facilitates the arrangement of the first connection line between the transistors, thereby avoiding an increase in the complexity of the manufacturing process.

It should be noted that, in the embodiments of the present disclosure, the first column of drive transistors in each set of transistors may be the first column from the left or the first column from the right, which is not limited in the embodiments of the present disclosure. In the example shown in FIG. 1, the first column from the left is taken as an example for explanation.

In some embodiments, as shown in FIG. 1, in each set of transistors, the first pole of each drive transistor, except the target column of drive transistors (for example, the first column of transistors in FIG. 1), is connected to the second pole of the drive transistor located in the next row of the previous column of drive transistors.

For example, in the array substrate shown in FIG. 1, each set of transistors 01 can include three columns of drive transistors, and in the first set of transistors 01, the first pole of each target drive transistor in the first column of drive transistors is connected to the data line S1. The first pole of the drive transistor M22 of the second row of the second column may be connected to the second pole of the target drive transistor M31 of the third row of the first column, and the first pole of the drive transistor M13 of the first row of the third column may be connected to the second pole of the drive transistor M22 of the second row of the second column. Accordingly, the target drive transistor M31 in the first column of drive transistors can write the data signal written by the data line S1 to the drive transistor M22 firstly, and then the drive transistor M22 can write the data signal to the drive transistor M13. Thus, the one data line S1 can provide data signals for the three drive transistors. Since the three drive transistors are located in different rows, that is, connected to different gate lines, it is possible to control the timing of outputting the gate drive signals by the respective gate lines, thereby realizing the function of outputting different data signals to different drive transistors by one data line.

Figure 2:
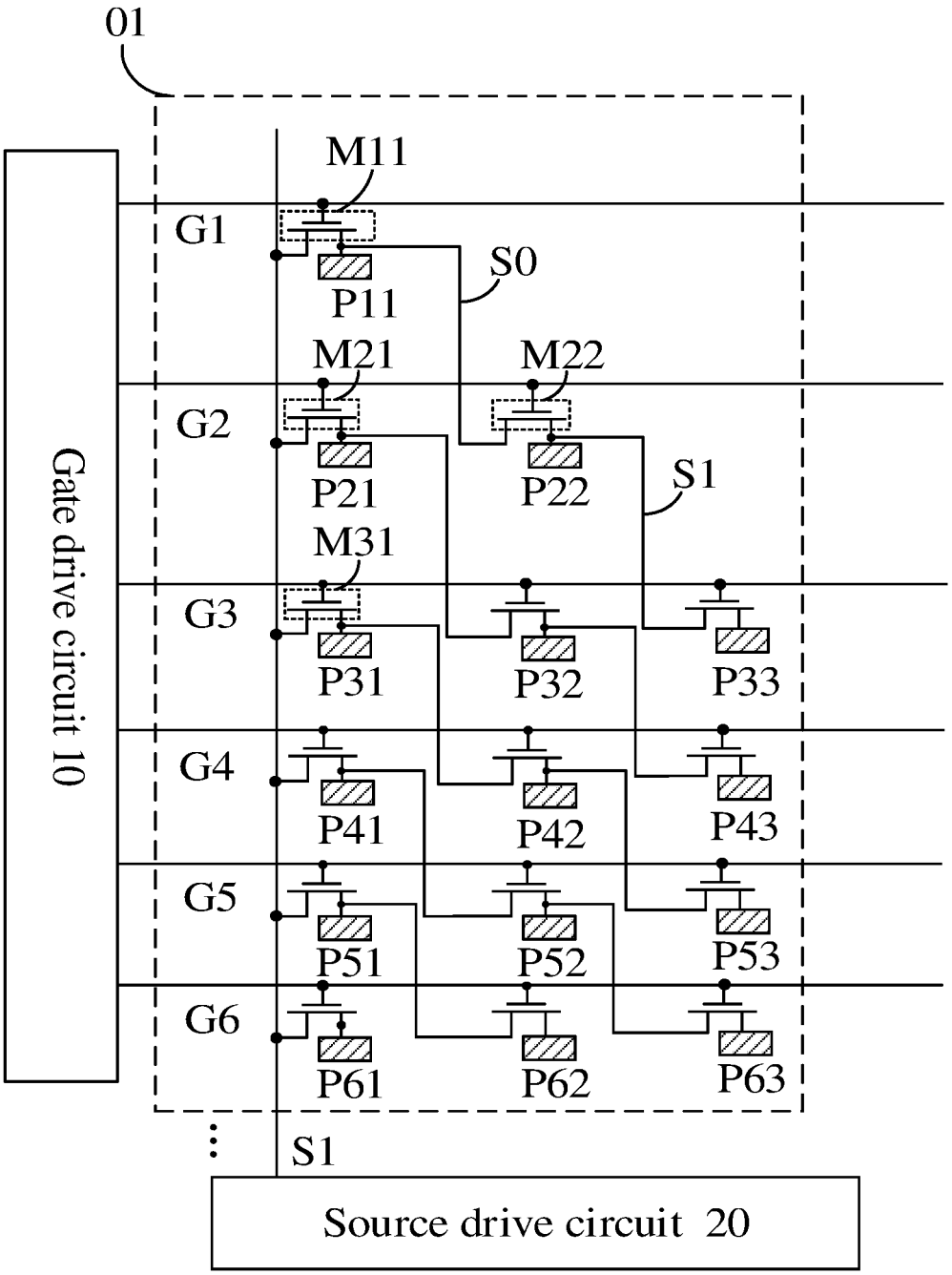
FIG. 2 is a schematic view showing a structure of an array substrate according to another embodiment of the present disclosure.

In some embodiments, as shown in FIG. 2, in each set of transistors, the first pole of each drive transistor, except the target column of drive transistors (for example, the first column of transistors in FIG. 2), is connected to the second pole of the drive transistor located in the previous row of the previous column of drive transistors.

For example, in the array substrate shown in FIG. 2, in the first set of transistors 01, the first pole of each target drive transistor in the first column of drive transistors is connected to the data line S1. The first pole of the drive transistor M22 of the second row of the second column may be connected to the second pole of the target drive transistor M11 of the first row of the first column. The first pole of the drive transistor M33 of the third row of the third column may be connected to the second pole of the drive transistor M22 of the second row of the second column. That is, the first pole of the drive transistor M33 can be connected to the second pole of the target drive transistor M11 through the drive transistor M22. The target drive transistor M11 in the first column of drive transistors can write the data signal written by the data line S1 to the drive transistor M22 firstly, and then the drive transistor M22 can write the data signal to the drive transistor M33. Thus, the one data line S1 can provide data signals for the three drive transistors.

It should be noted that, in the embodiments of the present disclosure, in order to ensure that each drive transistor in each set of transistors can be connected to the target drive transistor, the number of the target drive transistors included in the target column of drive transistors may be greater than the number of the drive transistors included in other column of drive transistors. For example, the number of the target drive transistors included in the first column of drive transistors is one more than the number of the drive transistors included in the second column of drive transistors, and the number of the drive transistors included in the second column of drive transistors is one more than the number of the drive transistors included in the third column of drive transistors.

The one more drive transistor in each column of drive transistors than the other column of drive transistors can also be called a dummy transistor. The dummy transistor can be located in a non-display area of the base substrate, and does not affect the display effect of the display device.

For example, as can be seen from FIG. 2, the first column of drive transistors has one more target drive transistor M11 than the second column of drive transistors, and the second column of drive transistors has one more drive transistor M22 than the third column of drive transistors. The target drive transistor M11, the target drive transistor M21 of the second row of the first column, and the drive transistor M22 of the second row of the second column are all dummy transistors, and may all be located in the non-display area.

In some embodiments, the first pole of each drive transistor, except the target column of drive transistors, can be directly connected to the second pole of the drive transistor located in a different row of the previous column of drive transistors through the first connection line, and the first connection line is disposed in the same layer as the pixel electrode in the array substrate. That is, the first connection line and the pixel electrode can be formed by one patterning process, and both can be made of Indium tin oxide (ITO) material. Provision of the first connection line and the pixel electrode in the same layer can avoid the first connection line from crossing the gate line or data line.

For example, referring to FIG. 2, the first pole of the drive transistor M22 can be connected to the second pole of the target drive transistor M11 through the first connection line S0, and the first pole of the drive transistor M33 can be connected to the second pole of the drive transistor M22 through the first connection line S1.

In the embodiments of the present disclosure, referring to FIG. 1 and FIG. 2, the base substrate of the array substrate may further be disposed with a gate drive circuit 10, that is, the array substrate can implement gate driving by using GOA technology, thereby effectively reducing the border of the display device.

The gate drive circuit 10 can be connected to each of the plurality of gate lines, respectively. The gate drive circuit 10 in FIGS. 1 and 2 can be connected to the gate line G1 to the gate line G6, respectively. The gate drive circuit 10 can provide a gate drive signal for the plurality of array-distributed drive transistors in the array substrate through the plurality of gate lines, thereby controlling the plurality of drive transistors to be turned on or off.

Figure 3:
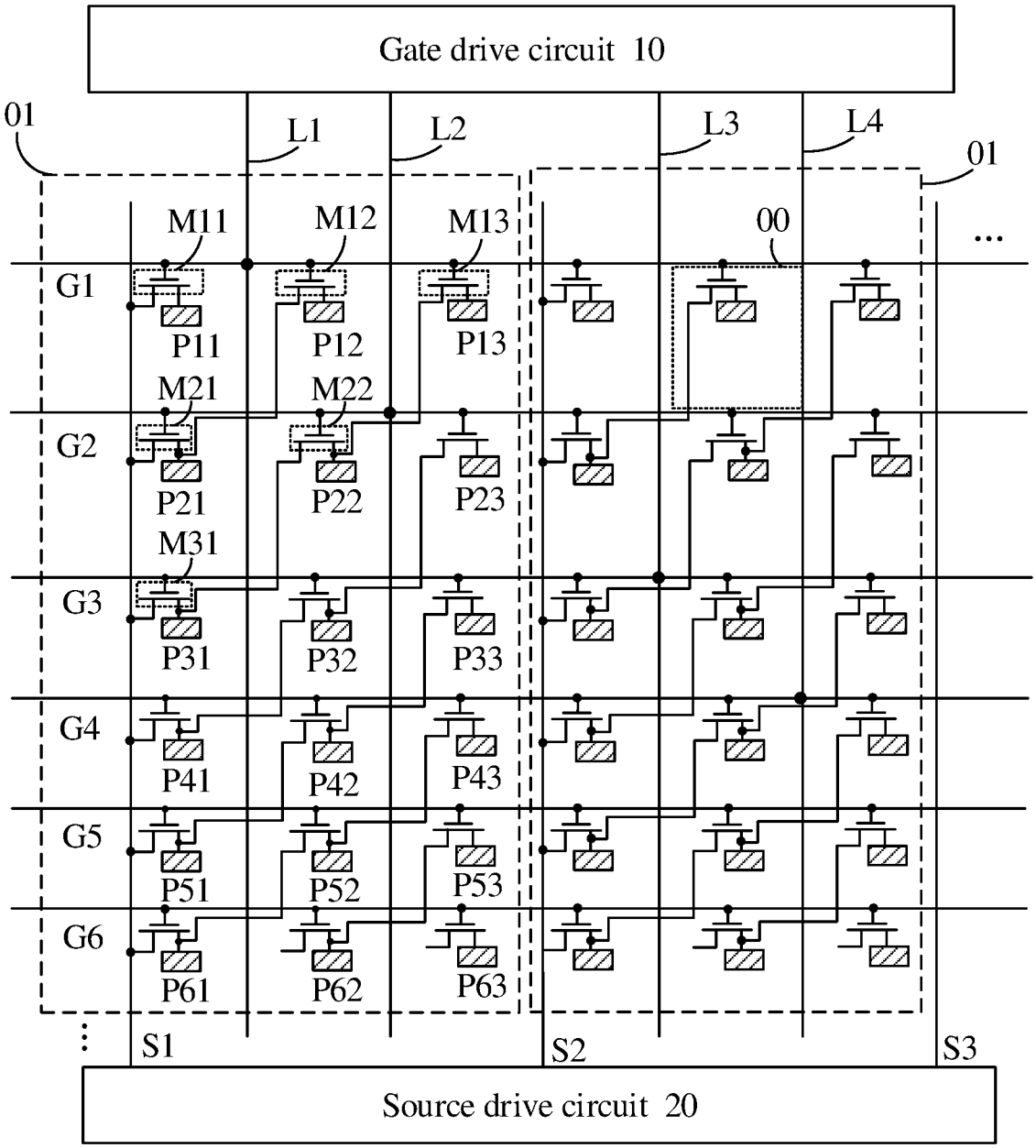
FIG. 3 is a schematic view showing a structure of an array substrate according to yet another embodiment of the present disclosure.

FIG. 3 is a schematic view showing a structure of an array substrate according to yet another embodiment of the present disclosure. As can be seen from FIG. 3, a source drive circuit 20 may further be disposed on one side of the base substrate in the array substrate, and a plurality of data lines in the array substrate may be used for connection with the source drive circuit 20. The data lines S1, S2, and S3 in FIG. 1 may be connected to the source drive circuit 20. The source driving circuit 20 can provide data signal for each column of drive transistors in the array substrate through the plurality of data lines, so that the drive transistor in the turn-on state writes the data signal into the pixel electrode connected thereto.

As shown in FIG. 3, the gate drive circuit 10 may be disposed on a side of the base substrate opposite to the source drive circuit 20, that is, the gate drive circuit 10 may be disposed on the side of a display area of the base substrate away from the source drive circuit 20. The other sides of the base substrate (e.g., the left and right sides shown in FIG. 3) need only be arranged with a ground line, a common electrode, a start signal line, and a clock signal line.

In the embodiments of the present disclosure, by providing the gate drive circuit 10 on the side opposite to the source drive circuit 20, no circuit that occupies a large area, such as the gate drive circuit 10 and the source drive circuit 20, is required to be disposed at the other two sides (for example, the left and right sides shown in FIG. 3) of the base substrate, which reduces the border area of the left and right sides of the array substrate, thereby facilitating the realization of the narrow-border display panel.

In the embodiments of the present disclosure, as shown in FIG. 1, a plurality of data lines in the array substrate may extend along a first direction X, and a plurality of gate lines in the array substrate may extend along a second direction Y, and the first direction X is perpendicular to the second direction Y. Referring to FIG. 1, the source drive circuit 20 may be disposed at one end of the plurality of data lines and disposed perpendicular to the plurality of data lines, that is, parallel to the plurality of gate lines. Since the gate drive circuit 10 is disposed opposite to the source drive circuit 20, the gate drive circuit 10 is also disposed parallel to the plurality of gate lines.

In order to ensure the effective connection between the gate drive circuit 10 and the respective gate lines, and to minimize the wiring in the array substrate, a plurality of second connection lines, such as the second connection line L1 to the second connection line L4 in FIG. 3, may also be disposed on the base substrate. The gate drive circuit 10 can be connected to the plurality of gate lines in a one-to-one correspondence through the plurality of second connection lines.

For example, the gate drive circuit 10 in the array substrate shown in FIG. 3 can be connected to the gate line G1 through one second connection line L1. As can be seen from FIG. 3, the extending direction of each of the second connecting lines may be parallel to the extending direction X of the data lines.

In the embodiments of the present disclosure, the plurality of second connection lines and the plurality of data lines may be disposed in the same layer. That is, the plurality of second connection lines and the plurality of data lines can be formed by one patterning process, thereby avoiding an increase in the complexity of the manufacturing process of the array substrate. For example, the plurality of second connection lines and the plurality of data lines may all be located in a source-drain metal layer in the array substrate.

In some embodiments, the number of columns of drive transistors included in each set of transistors in the array substrate may equal to the number of sub-pixels included in each pixel of the array substrate. Correspondingly, in each set of transistors, at least two drive transistors in the same row belong to the same pixel.

For example, assume that each pixel in the array substrate includes three sub-pixels, referring to FIG. 1 through FIG. 3, each set of transistors may include three columns of drive transistors, and three drive transistors in the same row belong to the same pixel.

In the embodiments of the present disclosure, in a situation where each set of transistors include three columns of drive transistors, each data line only needs to be connected to the first pole of each target drive transistor in the first column of drive transistors of the three columns of drive transistors, so that the data signal can be written into each drive transistor of the three columns of transistors, which saves two-thirds of the wiring space of the data line, and the saved two-thirds of the wiring space of the data line is enough to be arranged with the second connection line that is connected to the gate line.

For example, if the resolution of the display panel is 1920×1200, that is, in the array substrate of the display panel, the number of columns of pixels is 1920 and the number of rows of pixels is 1200, then, the number of the data lines required to be disposed in the array substrate is 1920, and the number of gate lines required to be disposed is 1200. Compared with the related art, the number of the disposed data lines that can be saved is 1920×2=3840. The wiring space saved in the array substrate is sufficient to arrange second connection lines connected to 1200 gate lines. Or else, if the resolution of the display panel is 1200×1920, that is, in the array substrate, the number of columns of the pixels is 1200 and the number of rows is 1920, then, the number of data lines required to be disposed in the array substrate is 1200, and the number of gate lines required to be disposed is 1920. Compared with the related art, the number of the disposed data lines that can be saved is 1200×2=2400. The wiring space saved in the array substrate is also sufficient to arrange the second connection lines connected with 1920 gate lines.

In the embodiments of the present disclosure, since each data line needs to charge three columns of drive transistors, the charging time of each drive transistor for charging the pixel electrode is one third of the charging time of the drive transistor in a conventional array substrate. In order to avoid the problem of insufficient charging, the material of the active layer of the drive transistor may be a material that can achieve higher charging efficiency, such as a metal oxide material or a low-temperature polysilicon material.

In a word, in the array substrate according to the embodiments of the present disclosure, in at least two columns of drive transistors included in each set of transistors, only the target column of drive transistors need to be connected with the data line, and the other columns of drive transistors can achieve the reception of data signals through the connection with the target column of drive transistors. Accordingly, each data line only needs to be connected to the first column of drive transistors in one set of transistors, to provide data signals for a plurality of columns of drive transistors in the set of transistors, which reduces the number of data lines required to be disposed in the array substrate, and the wiring space required by the data lines is reduced, thereby enabling the realization of the narrow-border display panel.

Figure 4:
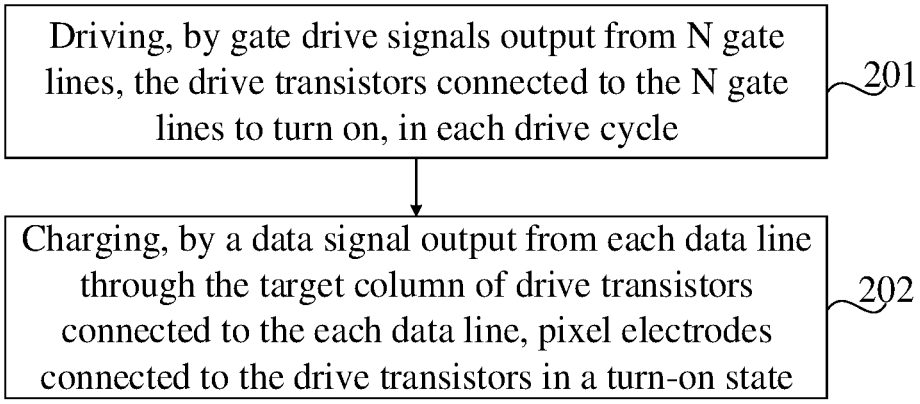
FIG. 4 is a flow diagram showing a method of driving an array substrate according to an embodiment of the present disclosure.

FIG. 4 is a flow diagram showing a method of driving an array substrate according to an embodiment of the present disclosure, which can be applied on the array substrate shown in any of FIG. 1 to FIG. 3. As shown in FIG. 4, the method can include a plurality of drive cycles.

A step 201 is to drive, by gate drive signals output from N gate lines, the drive transistors connected to the N gate lines to turn on, in each drive cycle.

N is the number of columns of drive transistors included in each set of transistors of a plurality of sets of transistors included in the array substrate, that is, N Z 2. For example, assume that, as shown in FIGS. 1 to 3, among the plurality of sets of transistors included in the array substrate, each set of transistors includes three columns of drive transistors, that is, N=3. Then, in each driving cycle, three gate lines output gate driving signals, and the drive transistors connected to the three gate lines are driven to be turned on.

A step 202 is to charge, by a data signal output from each data line through the target column of drive transistors connected to the each data line, pixel electrodes connected to the drive transistors in a turn-on state.

In the embodiments of the present disclosure, the plurality of data lines can simultaneously output the data signals, the target drive transistor in the turn-on state, and the other drive transistors connected to the target drive transistor and in the turn-on state can receive the data signals, and can charge the pixel electrodes.

By controlling the timing of the outputs of the gate drive signals by the N gate lines, the function of writing different data signals to different pixel electrodes can be realized.

For example, if the connection relationship of these drive transistors in the array substrate is as shown in FIG. 1 or FIG. 3, when a third data signal needs to be written to the pixel electrode P13, the gate line G1, the gate line G2, and the gate line G3 may be controlled to respectively output the gate drive signals, the other gate lines stop outputting the gate drive signals, and the data line S1 is controlled to output the third data signal. When a second data signal needs to be written to the pixel electrode P12, the gate line G1 and the gate line G2 may be controlled to respectively output gate drive signals, the other gate lines stop outputting the gate driving signals, and the data line S1 is controlled to output the second data signal. When a first data signal needs to be written to the pixel electrode P11, the gate line G1 may be controlled to output a gate driving signal, the other gate lines stop outputting the gate driving signals, and the data line S1 is controlled to output the first data signal.

In a word, in the method of driving an array substrate according to the embodiments of the present disclosure, data signals can be provided to at least two columns of drive transistors in each set of transistors through one data line, which reduces the number of data lines required to be disposed in the array substrate, and the wiring space required by the data lines is reduced, thereby enabling the realization of the narrow-border display panel.

In the embodiments of the present disclosure, as shown in FIG. 1 to FIG. 3, in each set of transistors, the first pole of each drive transistor, except the target column of drive transistors, may be directly connected to the second pole of the drive transistor located in a different row in the previous column of drive transistors. Then, the N gate lines outputting the gate driving signals in each drive cycle may be N adjacent gate lines. Correspondingly, among two adjacent drive cycles, the first one of the N gate lines outputting the gate drive signal in the first drive cycle and the first one of the N gate lines outputting the gate drive signal in the second drive cycle can be separated by one row.

For example, assume that N=3, among two adjacent drive cycles, the first one of the three gate lines outputting the gate drive signal in the first drive cycle and the first one of the three gate lines outputting the gate drive signal in the second drive cycle can be separated by one row. For example, for the array substrate shown in FIG. 1 or FIG. 3, the first one of the three gate lines outputting the gate drive signal in the first drive cycle is the gate line G1, and the first one of the three gate lines outputting the gate drive signal in the second drive cycle is the gate line G2.

In the embodiments of the present disclosure, each drive cycle includes N drive phases. Assume that, as shown in FIG. 1 and FIG. 3, in each set of transistors, the first pole of each drive transistor, except the target column of drive transistors, is directly connected to the second pole of the drive transistor in the next row of the previous column of drive transistors. Then, in an nth drive phase of the N drive phases, the first N−n+1 gate lines of the N adjacent gate lines output gate drive signals, where n is a positive integer not greater than N.

For example, assume that as shown in FIG. 1 and FIG. 3, each set of transistors disposed on the array substrate include totally three columns of transistors, and each drive cycle may include three (i.e., N=3) drive phases. In the first drive phase, the three adjacent gate lines each output a gate drive signal. In the second drive phase, the first two gate lines of the three adjacent gate lines each output a drive signal, that is, the first and second gate lines output gate drive signals, and the third gate line stops outputting gate drive signal. In the third drive phase, the first gate line of the three adjacent gate lines outputs a gate drive signal, and the second gate line and the third gate line stop outputting the gate drive signal.

Assume that, as shown in FIG. 2, in each set of transistors, the first pole of each drive transistor, except the target column of drive transistors, is directly connected to the second pole of the drive transistor located in a previous row of the previous column of drive transistors. Then, in an nth drive phase of the N drive phases, the last N−n+1 gate lines of the N adjacent gate lines output gate driving signals, where n is a positive integer not greater than N.

For example, assume that as shown in FIG. 2, each set of transistors disposed on the array substrate includes totally three columns of transistors, and each drive cycle may include three (i.e., N=3) drive phases. In the first drive phase, the three adjacent gate lines each output a gate drive signal. In the second drive phase, the last two gate lines of the three adjacent gate lines each output a drive signal, that is, the second and third gate lines output gate drive signals, and the first gate line stops outputting a gate drive signal. In the third drive phase, the last gate line of the three adjacent gate lines outputs a gate drive signal, and the first gate line and the second gate line stop outputting the gate drive signal.

Figure 5:
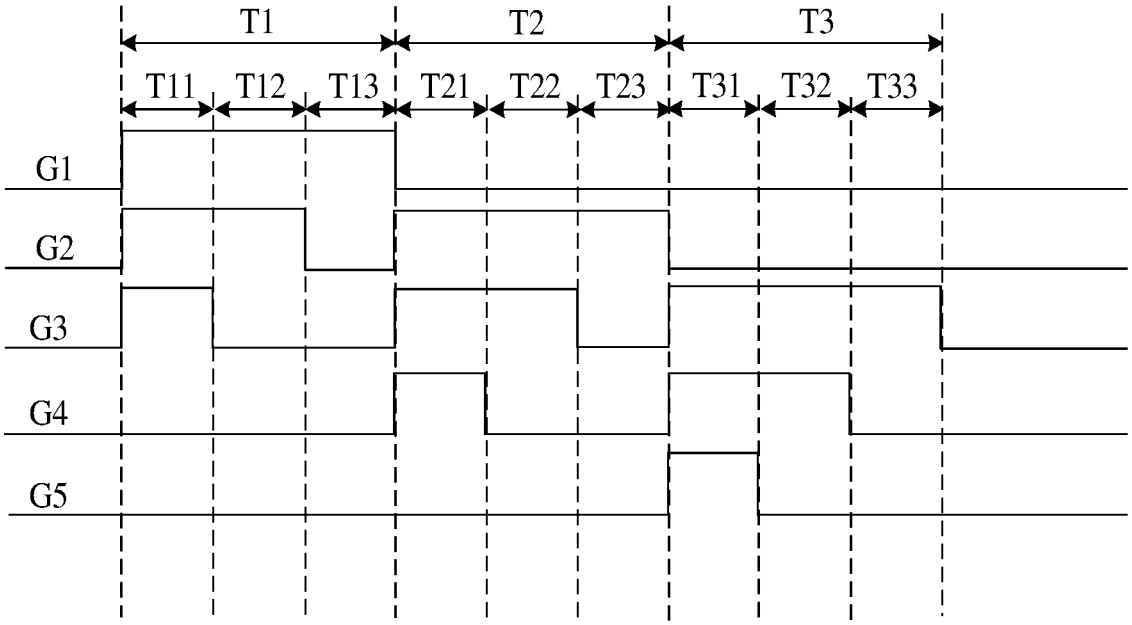
FIG. 5 is a timing diagram showing a method of driving an array substrate according to the embodiment of the present disclosure.

FIG. 5 is a timing diagram of an array substrate gate drive circuit according to the embodiments of the present disclosure. Taking the array substrate shown in FIG. 1 and FIG. 3 as an example, and using each of the drive transistors in the array substrate as an N-type transistor, the driving principle of the array substrate according to the embodiments of the present disclosure is described in detail.

As shown in FIG. 5, in the first drive phase T11 of the first drive cycle T1, the three adjacent gate lines G1, G2, and G3 each output a gate drive signal, and the drive transistors connected to the three gate lines, that is, the first row of drive transistors, the second row of drive transistors, and the third row of drive transistors, are driven by the three adjacent gate lines to be turned on. In the first drive phase T11, the other rows of gate lines do not output the gate drive signal, and the other rows of drive transistors are turned off. At this time, as shown in Table 1, the source drive circuit 20 can output the data signal D13 corresponding to the pixel electrode P13 of the first row of the third column, and the data line S1 can first write the data signal D13 corresponding to the pixel electrode P13 to the pixel electrode P11, the pixel electrode P21, and the pixel electrode P31. Further, the pixel electrode P21 can write the data signal D13 of the pixel electrode P13 into the pixel electrode P12, and the pixel electrode P31 can write the data signal D13 of the pixel electrode P13 into the pixel electrode P22 and the pixel electrode P13. Since the other rows of drive transistors are not turned on, no data signals are written to the other rows of pixel electrodes.

In the second phase T12 of the first drive cycle T1, the first two gate lines G1 and G2 of the three adjacent gate lines each output a gate drive signal, while the rest gate lines do not output a gate drive signal. At this time, the first row of drive transistors and the second rows of drive transistors are turned on, and the other rows of drive transistors are turned off. As shown in Table 1, at this time, the source drive circuit 20 can output the data signal D12 corresponding to the pixel electrode P12 of the first row of the second column, and the data line S1 can first write the data signal D12 of the pixel electrode P12 into the pixel electrode P11 and the pixel electrode P21. Further, the pixel electrode P21 can write the data signal D12 of the pixel electrode P12 into the pixel electrode P12. At the same time, in the first drive phase T11, the data signal D13 of the pixel electrode P13 has been written into the pixel electrode P13, the pixel electrode P22 and the pixel electrode P31, and in the second drive phase T12, the third gate line G3 have stopped outputting the gate driving signals, and accordingly the data signals in the pixel electrode P13, the pixel electrode P22, and the pixel electrode P31 remain unchanged. And, since the other rows of drive transistors are not yet turned on, the other rows of pixel electrodes are written with no data signal.

In the third drive phase T13 of the first drive cycle T1, the first gate line G1 of the three adjacent gate lines outputs a gate drive signal, and the rest gate lines do not output a gate drive signal. At this time, the first row of drive transistors are turned on, and the other rows of drive transistors are turned off. As shown in Table 1, at this time, the source drive circuit 20 can output the data signal D11 of the pixel electrode P11 of the first row of the first column, and the data line S1 can write the data signal D11 of the pixel electrode P11 into the pixel electrode P11. At the same time, in the first drive phase T11, the pixel electrode P13, the pixel electrode P22 and the pixel electrode P31 have been written with the data signal of the pixel electrode P13, and in the second drive phase T12, the pixel electrode P21 and the pixel electrode P12 have been written with the data signal of the pixel electrode P12, and in the third drive phase T13, the second gate line G2 and the third gate line G3 have stopped outputting the gate drive signal, and accordingly, the pixel electrode P21 and the pixel electrode P12 hold the data signal D12 of the pixel electrode P12 unchanged, and the pixel electrode P13, the pixel electrode P22, and the pixel electrode P31 hold the data signal D13 of the pixel electrode P13 unchanged. And since the other rows of drive transistors are not yet turned on, the other rows of pixel electrodes are written with no data signal.

TABLE 1

| Pixel | Drive Cycle | | | | | | | | |
|---|---|---|---|---|---|---|---|---|---|
| | T1 | | | T2 | | | T3 | | |
| Electrode | T11 | T12 | T13 | T21 | T22 | T23 | T31 | T32 | T33 |
| | Date Signal | | | | | | | | |
| P11 | D13 | D12 | D11 | D11 | D11 | D11 | D11 | D11 | D11 |
| P12 | D13 | D12 | D12 | D12 | D12 | D12 | D12 | D12 | D12 |
| P13 | D13 | D13 | D13 | D13 | D13 | D13 | D13 | D13 | D13 |
| P21 | D13 | D12 | D12 | D23 | D22 | D21 | D21 | D21 | D21 |
| P22 | D13 | D13 | D13 | D23 | D22 | D22 | D22 | D22 | D22 |
| P23 | | | | D23 | D23 | D23 | D23 | D23 | D23 |
| P31 | D13 | D13 | D13 | D23 | D22 | D22 | D33 | D32 | D31 |
| P32 | | | | D23 | D23 | D23 | D33 | D32 | D32 |
| P33 | | | | | | | D33 | D33 | D33 |
| P41 | | | | D23 | D23 | D23 | D33 | D32 | D32 |
| P42 | | | | | | | D33 | D32 | D33 |
| P43 | | | | | | | | | |
| P51 | | | | | | | D33 | D33 | D33 |
| P52 | | | | | | | | | |
| P53 | | | | | | | | | |

It can be seen from TABLE 1 that, after the first drive cycle T1, the three pixel electrodes P11, P12 and P13 included in the pixel of the first row of the first column of the array substrate can be respectively written with the corresponding data signals D11, D12 and D13, thereby the normal display of the image can be achieved.

Continue to refer to TABLE 1, in the second drive cycle T2, the pixel electrode P11 has been written with the data signal of the pixel electrode P11 in the first drive cycle T1, the pixel electrode P12 has been written with the data signal of the pixel electrode P12 in the first drive cycle T1, and the pixel electrode P13 has been written with the data signal of the pixel electrode P13 in the first drive cycle T1, and, in the second drive cycle T2, the drive transistors in the first row are in the turn-off state. Accordingly, the potentials of the pixel electrode P11, the pixel electrode P12, and the pixel electrode P13 remain unchanged.

Also shown in FIG. 5 are a timing diagram of three drive phases T21, T22 and T23 of the second drive cycle T2, and a timing diagram of three drive phases T31, T32 and T33 in the third drive cycle T3. In the second drive cycle T2, the gate lines G2, G3, and G4 sequentially output gate drive signals, and in the third drive cycle T3, the gate lines G3, G4, and G5 sequentially output gate drive signals. The driving methods of the three drive phases of the second drive cycle T2 and the three drive phases of the third drive cycle T3 are the same as the drive method of the three drive phases of the first drive cycle T1, which are not described repeatedly in the embodiments of the present disclosure.

It should be noted that, in the embodiments of the present disclosure, the data signals provided by the data lines in each of the drive phases of each driving cycle may be adjusted according to actual conditions, which is not limited in the embodiments of the present disclosure.

In a word, in the method of driving an array substrate according to the embodiments of the present disclosure, data signals can be provided to at least two columns of drive transistors in each set of transistors through one data line, which reduces the number of data lines required to be disposed in the array substrate, and the wiring space required by the data lines is reduced, thereby enabling the realization of the narrow-border display panel.

Figure 6:
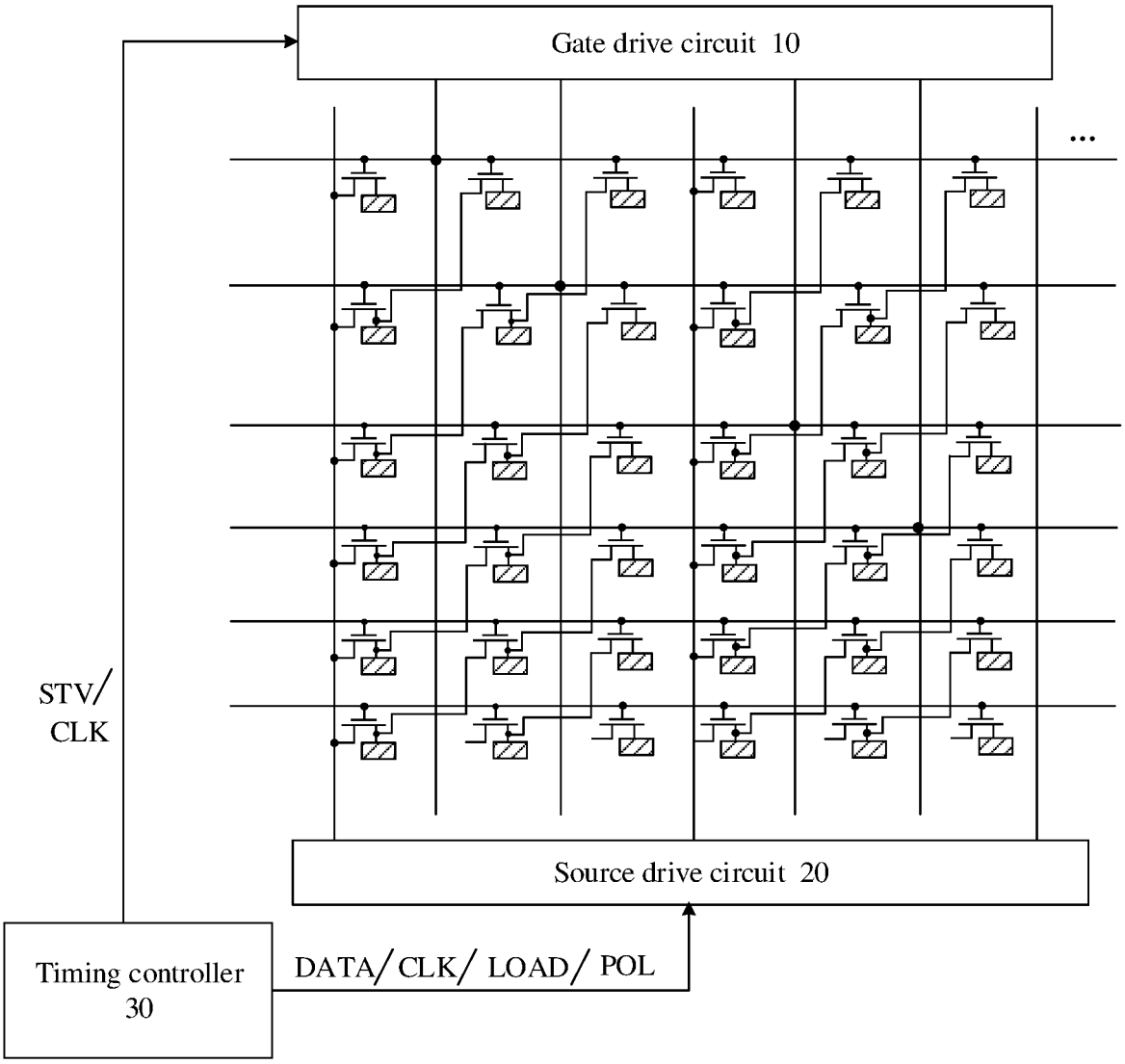
FIG. 6 is a schematic view showing a structure of a display device according to an embodiment of the present disclosure.

FIG. 6 is a schematic view showing a structure of a display device according to an embodiment of the present disclosure. As shown in FIG. 6, the display device may include: an array substrate as shown in any one of FIG. 1 to FIG. 3.

As shown in FIG. 6, the display device may further include a source drive circuit 20 and a timing controller 30. The source drive circuit 20 may be connected to an input end of the plurality of data lines in the array substrate, so as to provide data signals to pixel electrodes in the pixel area through the data lines. Moreover, the source drive circuit 20 and the gate drive circuit 10 in the array substrate may be disposed on two opposite sides of the base substrate.

Referring to FIG. 6, the timing controller 30 can be connected to the source drive circuit 20 and the gate drive circuit 10 in the array substrate, respectively. The timing controller 30 can input a vertical start scan pulse signal STV and a clock signal CLK to the gate drive circuit 10. The timing controller 30 can input a data signal DATA, a clock signal CLK, a load signal LOAD, and a reverse polarity signal POL to the source drive circuit 20.

In the embodiments of the present disclosure, the display device may be any product or part that has a display function, such as a liquid crystal panel (including an oxide liquid crystal panel and a low temperature polysilicon liquid crystal panel), an electronic paper, an OLED panel, an AMOLED panel, a mobile phone, a tablet computer, a television, a display, a notebook computer, a digital photo frame or navigator.

The above description is only exemplary embodiments of the present disclosure, and is not intended to limit the disclosure. Any modifications, equivalents, improvements, etc., made within the spirit and principles of the present disclosure should be included in the protective scope of the present disclosure.

What is claimed is:

1. An array substrate, comprising:

a base substrate; and a plurality of data lines and a plurality of array-distributed drive transistors on the base substrate;

wherein:

the plurality of array-distributed drive transistors comprise: a plurality of sets of transistors in a one-to-one correspondence with the plurality of data lines, each set of transistors comprising at least two columns of drive transistors;

in the plurality of data lines, each data line is connected to a first pole of each target drive transistor in a target column of drive transistors of a corresponding set of transistors, the target column of drive transistors are one column of drive transistors in one set of transistors;

in each set of transistors, the first pole of at least one drive transistor, other than the target drive transistor, is connected to a second pole of a target drive transistor located in a different row, and wherein another drive transistor, other than the target drive transistor, in the same row is connected to a drive transistor which is not a target drive transistor; and the first pole and the second pole are respectively a source and a drain, or the first pole and the second pole are respectively a drain and a source;

wherein in each set of transistors, the first pole of each drive transistor, other than the target drive transistor, is directly connected to a second pole of a drive transistor of a previous column of drive transistors located in a different row through a first connection line, the first connection line is disposed in a same layer as a pixel electrode of the array substrate.

2. The array substrate of claim 1, wherein:

the target column of drive transistors are a first column of drive transistors in one set of transistors.

3. The array substrate of claim 1, wherein in each set of transistors, the first pole of each drive transistor, except the target column of drive transistors, is directly connected to a second pole of a drive transistor of the previous column of drive transistors located in a next row.

4. The array substrate of claim 1, wherein in each set of transistors, the first pole of each drive transistor, except the target column of drive transistors, is directly connected to a second pole of a drive transistor of the previous column of drive transistors located in a previous row.

5. The array substrate of claim 1, wherein the first connection line is made of indium tin oxide material.

6. The array substrate of claim 1, wherein the array substrate further comprises:

a plurality of gate lines and a gate drive circuit on the base substrate; and the gate drive circuit is connected to each of the plurality of gate lines, and each gate line is connected to gates of drive transistors located in a same row.

7. The array substrate of claim 6, wherein:

the gate drive circuit is located at a side of the base substrate opposite to a source drive circuit, and the gate drive circuit is connected to the plurality of gate lines through a plurality of second connection lines in a one-to-one correspondence manner; and the source drive circuit is located at a side of the base substrate and is configured for being connected to the plurality of data lines.

8. The array substrate of claim 7, wherein the second connection lines are in parallel with the data lines.

9. The array substrate of claim 8, wherein the second connection lines are disposed in a same layer with the data lines.

10. The array substrate of claim 1, wherein the number of columns of drive transistors included in each set of transistors is equal to the number of sub-pixels included in each pixel of the array substrate.

11. The array substrate of claim 10, wherein each pixel comprises three sub-pixels, and each set of transistors comprise three columns of drive transistors.

12. A method of driving an array substrate, which is applied on the array substrate of claim 1, the method comprising:

implementing a plurality of drive cycles;

in each drive cycle, driving, by gate drive signals output from N gate lines, drive transistors connected to the N gate lines to turn on; and charging, by a data signal output from each data line through the target column of drive transistors connected to the each data line, pixel electrodes connected to the drive transistors in a turn-on state;

wherein, N is the number of columns of drive transistors included in each set of transistors in the plurality of sets of transistors included in the array substrate.

13. The method of claim 12, wherein the N gate lines are N adjacent gate lines, and in two adjacent drive cycles, a first gate line of the N gate lines outputting the gate drive signal in a first drive cycle is spaced apart by one row from a first gate line of the N gate lines outputting the gate drive signal in a second drive cycle.

14. The method of claim 13, wherein in each set of transistors, the first pole of each drive transistor, except the target column of drive transistors, is directly connected to a second pole of a drive transistor of the previous column of drive transistors located in a next row;

wherein each drive cycle comprises N drive phases;

wherein in an nth drive phase, first N−n+1 gate lines of the N adjacent gate lines output the gate drive signals; and wherein, n is a positive integer not greater than N.

15. The method of claim 13, wherein in each set of transistors, the first pole of each drive transistor, except the target column of drive transistors, is directly connected to a second pole of a drive transistor of the previous column of drive transistors located in a previous row;

wherein each drive cycle comprises N drive phases;

wherein in an nth drive phase, last N−n+1 gate lines of the N adjacent gate lines output the gate drive signals; and wherein, n is a positive integer not greater than N.

16. The method of claim 12, wherein each pixel in the array substrate comprises three sub-pixels, and N is equal to 3.

17. A display device comprising: the array substrate of claim 1.

18. The display device of claim 17, further comprising:

a source drive circuit;

wherein the source drive circuit is connected to the plurality of data lines in the array substrate, and the source drive circuit is disposed opposite to the gate drive circuit in the array substrate.

19. The display device of claim 18, further comprising:

a timing controller;

wherein the timing controller is connected to the source drive circuit and the gate drive circuit.

* * * * *